US005215493A

United States Patent [19]

Zgrodek et al.

[11] Patent Number: 5,215,493

[45] Date of Patent: Jun. 1, 1993

[54] STUFFED TOY WITH CHANGEABLE FACIAL EXPRESSION

[76] Inventors: Karen Zgrodek, 490A Straw Ridge Rd., Wallkill, N.Y. 12589; Stephanie Leechow, 5 Cresthaven Dr., New Windsor, N.Y. 12553

[21] Appl. No.: 896,397

[22] Filed: Jun. 10, 1992

[51] Int. Cl.[5] ..... A63H 3/02

[52] U.S. Cl. ..... 446/372; 446/268; 446/392

[58] Field of Search ..... 446/369, 268, 372, 370, 446/371, 321, 392, 391, 151, 149

[56] References Cited

U.S. PATENT DOCUMENTS

| | | | |
|---|---|---|---|
| 1,055,458 | 3/1913 | Goldenberg | 446/370 |
| 1,435,267 | 11/1922 | Vathé | 446/369 |
| 1,679,847 | 8/1928 | Webb | 446/268 X |
| 2,991,588 | 7/1961 | Williams | 446/392 |
| 4,798,556 | 1/1989 | Vicars et al. | 446/392 X |
| 4,950,194 | 8/1990 | Gullace | 446/369 X |

*Primary Examiner*—Mickey Yu

*Attorney, Agent, or Firm*—Sandra M. Kotin

[57] ABSTRACT

A stuffed toy generally in the configuration of a pickle having a textured body, soft curved arms capable of hugging a child or being folded in front of the body, flexible legs, and changeable facial features such as to exhibit either a sad face or a happy face. The expression being easily changed by even a very young child by merely rotating the eye and mouth members. The toy can be additionally dressed as male or female or as a baby. The pickle character lends itself to use by disturbed children to assist in ascertaining the nature of their problems, but is lovable and huggable so as to be used by all children.

8 Claims, 3 Drawing Sheets

STUFFED TOY WITH CHANGEABLE FACIAL EXPRESSION

FIELD OF THE INVENTION

The instant invention relates to a stuffed toy the main body of which is in the shape of a pickle, is green and is textured like a pickle. The toy has a soft curved arms and soft straight legs which are joined to the main body, and facial features which can be changed from smiling to frowning. Additionally, the toy can have hair and clothes such as to take the character of male or female, and baby, child or adult.

BACKGROUND OF THE INVENTION

There are a variety of stuffed dolls and toys on the market today which have many shapes and characteristics. There are no pickles. About ten years ago American Greetings sold a very small stuffed toy in the general shape of a pickle. This toy had a green fabric body that was painted to approximate the textured surface of a pickle, had long spindly striped arms and legs, and facial features of yarn that were glued on to the fabric. The doll had a cape as the only clothing. It was stuffed with clippings, synthetic fibers and crushed nut shells.

Most stuffed dolls and toys do not have movable parts or changeable features. They are primarily soft and cuddly toys meant to be played with and loved by their owners. Some have an added characteristic, for example, the ability to be used as a pillow or cushion. A recent example of this type of stuffed toy is the one formed in the shape of the wishbone of a bird. (U.S. Pat. No: 5,026,315).

There have been several stuffed toys with changeable faces. U.S. Pat. No. 3,783,553 shows a stuffed doll with a blank face made of a rigid plastic. The owner uses crayon or similar washable drawing material to draw in the facial features. The face can be changed at the whim of, and according to the talents of the owner.

U.S. Pat. No. 3,811,220 shows a rag doll which comes with a series of face panels which are permanently attached to the doll. To change the face, the user only has to fold down the face panel that is showing and slip it into a pouch built into the doll's torso. Thus the next face panel is revealed behind it.

Kinberg, in U.S. Pat. No. 3,863,386, teaches a doll with a layered face panel that is initially blank. The user draws in the features using a stylus. A dye between the layers can then be seen in the outline drawn. The lines are easily erased and the blank is ready for a new face.

A doll made of a series of interchangeable segments threaded onto a rod or post is taught by Isaf in U.S. Pat. No. 4,820,234. This is readily a doll's head wherein each feature may be changed by rotating one of the segments. The number of combinations possible is very large and covers a wide range of moods and expressions. A somewhat similar type of face changing toy is seen in U.S. Pat. No. Des. 307,307.

U.S. Pat. No. 4,842,565 shows a stuffed doll that reverses into another different entity, and U.S. Pat. No. 4,336,665 shows a stuffed toy with two different faces at opposite ends of an elongated body. The character is changed by flipping a reversible fabric shell fastened at the center of the body.

Rosenberg teaches a stuffed animal with facial features that can be changed by manipulating the outer skin about the face area. U.S. Pat. No. 4,648,851).

Good Housekeeping Magazine offers a doll-making kit for sale wherein the doll has four different facial expressions. The user removes the doll's hat which has the hair attached, swivels the head to reach the desired expression, and replaces the hat, thereby covering the other faces. (Good Housekeeping, May 1992, page 74).

BRIEF SUMMARY OF THE INVENTION

The instant invention relates to a stuffed toy in the basic shape and texture of a pickle with soft and flexible curved arms and flexible straight legs. More particularly, the toy has facial features that can be changed from a happy face to a sad face.

It is an object of the present invention to have the face change accomplished by turning a mouth member and eye members, steps simple enough to be performed even by a very young child.

It is also an object of the present invention to have the arms of the stuffed toy curved so they hang as if from shoulders and can hug the child or another doll or toy and can also be folded in front.

It is another object of the present invention to provide a doll that is soft and cuddly and encourages love, play, humor and compassion in its owner and user. It is a further object of the present invention to provide a doll that can be used not only as a toy by all children, but one that can be used by a child with family or emotional problems. Such a child can utilize the sad face or the happy face according to his or her mood or circumstance and can easily change the face as a counselor attempts to change the child's mood or to ascertain the exact nature of the child's problem or concern. The character of the pickle is helpful in working with children who have problems because the term "Pickle Puss" or "Sour Puss" can be used without leaving any bad feelings, or the child can be asked to have "Pickle Puss" tell why "he" is so sad or angry.

It is a still further object of the present invention to have such toys with the hair and clothes adaptable so as to provide baby pickles, boy and girl pickles and adult pickles which may be parents or other adults. Additionally, the clothes are not a part of the body structure of the toy and therefore can be removed and changed. Disturbed children can use all of the "family" to act out their problems. The toys are so endearing that they can be used by any chid just for fun.

It is a still further object of the present invention to have the stuffed toys made of a fabric that is textured like the outside of a pickle and yet be soft to the touch and quite huggable.

Another object of the present invention is to provide a stuffed toy that is easy to manufacture, durable and not expensive.

DETAILED DESCRIPTION OF THE INVENTION

Figure 1:
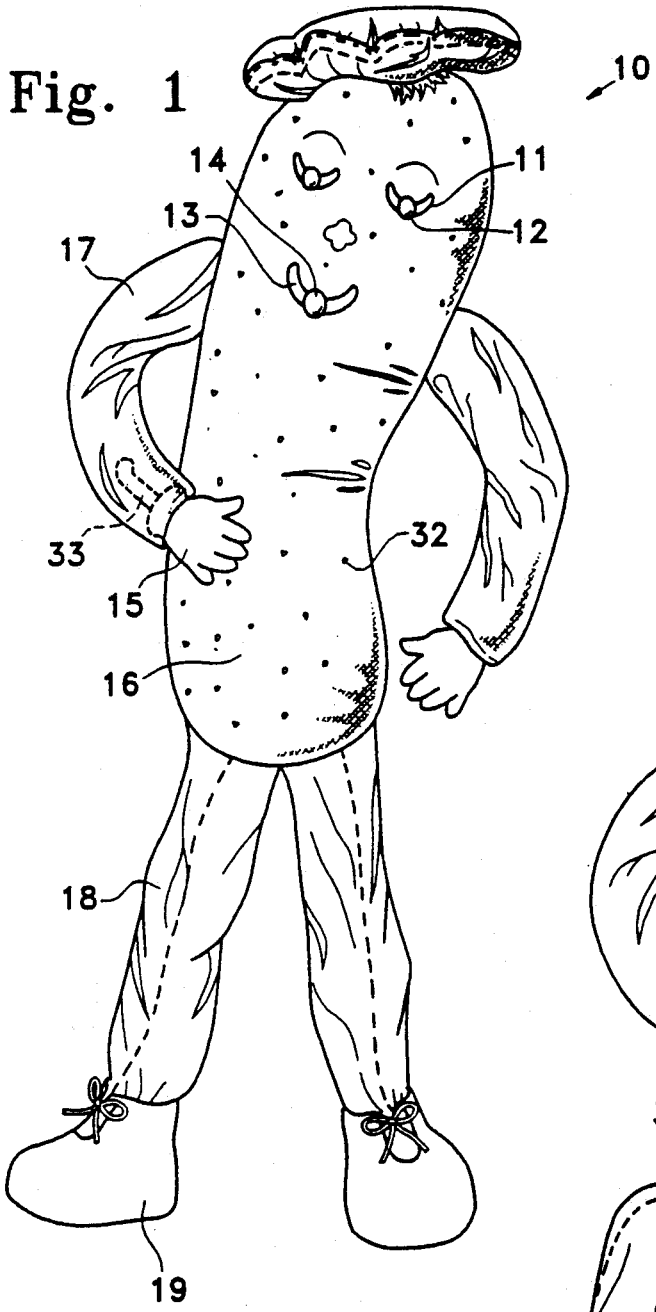
FIG. 1 is a front view of the stuffed toy of the invention standing and with the happy face.

The instant invention is a stuffed toy 10, the body 16 and limbs 17 and 18 of which each consist of two panels of a sturdy fabric, preferably a heavy grade cotton cloth, and stuffed with a soft stuffing material such as polyfill, shredded foam rubber, or other such material well known in the art. The body 16 and arms 17 are constructed of a front panel and a back panel, while the legs 18 are constructed of a right panel and a left panel. The panels are stitched together and the arms 17 and legs 18 are attached to the body 16 by being stitched within the body seams. The body 16 is fully stuffed so as to remain erect, while the limbs are not quite fully stuffed so as to be somewhat flexible. The arms 17 are curved, unlike those of most stuffed toys, and they hang as if from shoulders. The arms are capable of hugging a child, another toy or being folded in front of the body (see FIG. 7). Preformed hands 15 are affixed at the end of each arm 17. Suggested hands have a protruding body 33 (seen in FIG. 1) which extends up into the arm 17. The hand can be glued into the arm ends or affixed by other means known in the art. Such hands are well known and can be purchased at doll supply stores. (An example is sold by Westrim Crafts, Western Trimming Corp. Chatsworth, California, Style#9631 and made of a white plastic).

The legs 18 are straight with a foot portion 36 forming an L-shape at the end thereof. A removable doll's shoe 19 can easily be placed on each foot 36.

The arms 17 are attached within the side seams of the body 16 at a level about even with the mouth 34 and the legs 18 are attached within the bottom seam of the body 16.

Figure 2:
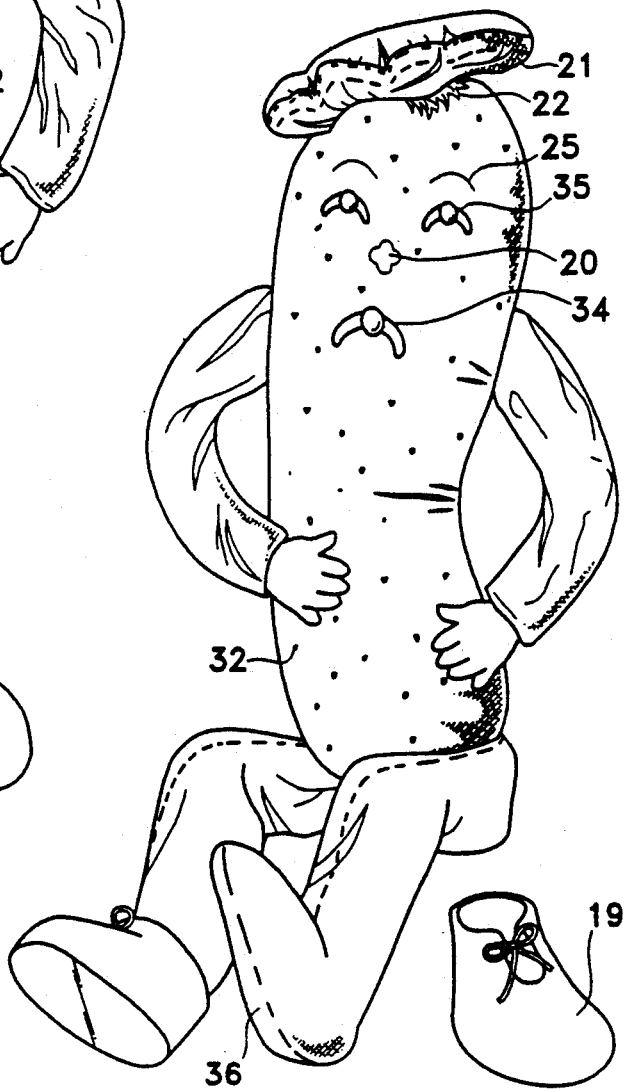
FIG. 2 is a perspective view of the stuffed toy seated, with one shoe off and with the sad face.
Figure 3:
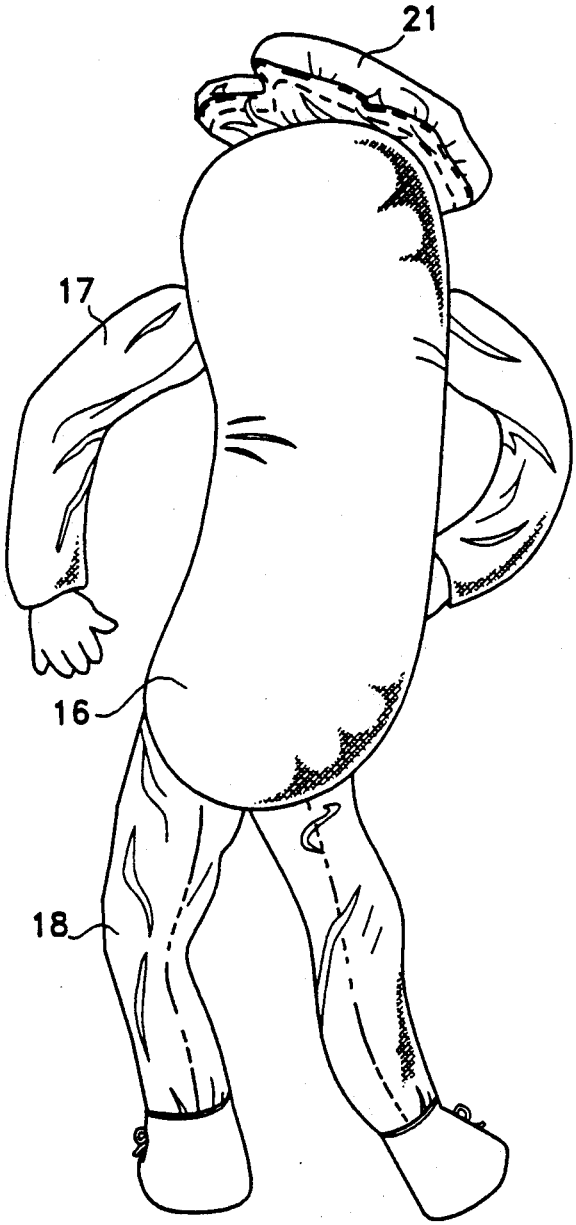
FIG. 3 is a back view of the stuffed toy standing.

The stuffed toy of the instant invention 10 can be seen in FIGS. 1, 2 and 3. The body 16 of the toy 10 is generally in the shape of a pickle. The fabric can be textured, or a polymeric material 32 can be applied to the fabric to simulate the nubby surface of a pickle. Ideally, the fabric used is green, though the toy may be of any color.

Figure 5:
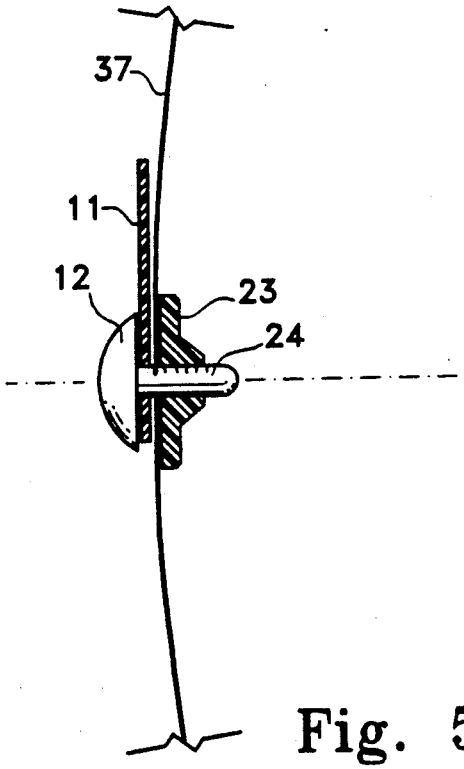
FIG. 5 is a cross sectional view through the eye area of the face showing the eye components.
Figure 6:
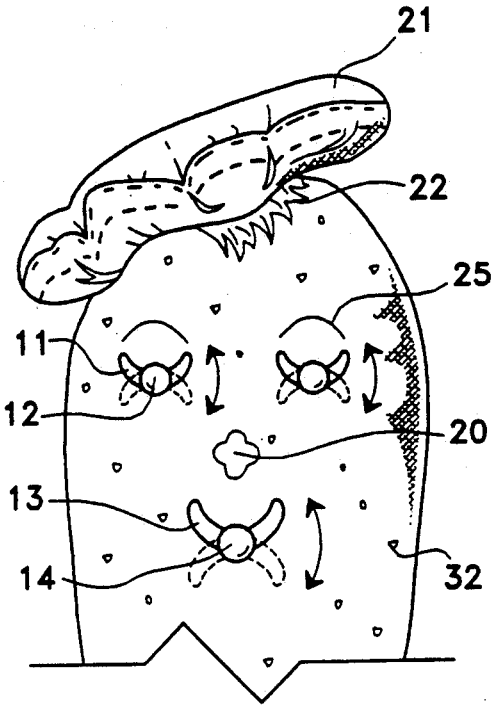
FIG. 6 is a close-up front view of the face of the stuffed toy showing the mouth member and eye members in changeable positions.

The eyes 35 consist of three parts, the stationary part or bolt 12, the movable part or eye member 11, and the washer 23. The bolt 12 has a notched shaft 24 which extends through the eye member and thereafter through the fabric of the face and then through the flanged washer 23 which locks in place on the shaft 24 behind the face and within the body of the toy (see FIG. 5). Once the washer 23 is set in place it cannot be moved either forward or backward along the shaft portion 24. The eye member 11 is generally synclinal in shape and made of a stiff but somewhat flexible material, preferably vinyl. The washer 23 is set in place such that there is enough space for the eye member 11 to be turned by hand (FIG. 6), but not so much space that it turns by itself when when the toy is moved. The bolt 12 and eye member 11 can be black or any other color desired.

The mouth 34 is made of the same three parts, a bolt 14, mouth member 13 and washer. The mouth member 13 is slightly larger than the eye member 11 but is of the same shape. Both the bolt 14 and mouth member 13 are preferably red. If a red bolt cannot be obtained, any bolt can be covered with red fabric. When the toy is made up as a female 31 as in FIG. 7, a red heartshaped member 29 can be added to the mouth 34 to give a it more bowshaped or feminine appearance. The heart-shaped member 29 is made of the same material as the the mouth member and the shaft of the bolt 14 passes through the heart shaped member 29 and the mouth member 13 before passing through the fabric and being locked in place with the washer.

Yarn hair 22 can be attached to the top of the head of the doll (see FIGS. 1 and 2). If the toy is female 31, synthetic hair 26 can be attached all over the head portion (FIG. 7).

Eyebrows 25 may be painted or embroidered on the face. When the toy is female, eyelashes 27 may be painted or embroidered just above the eyes.

Figure 7:
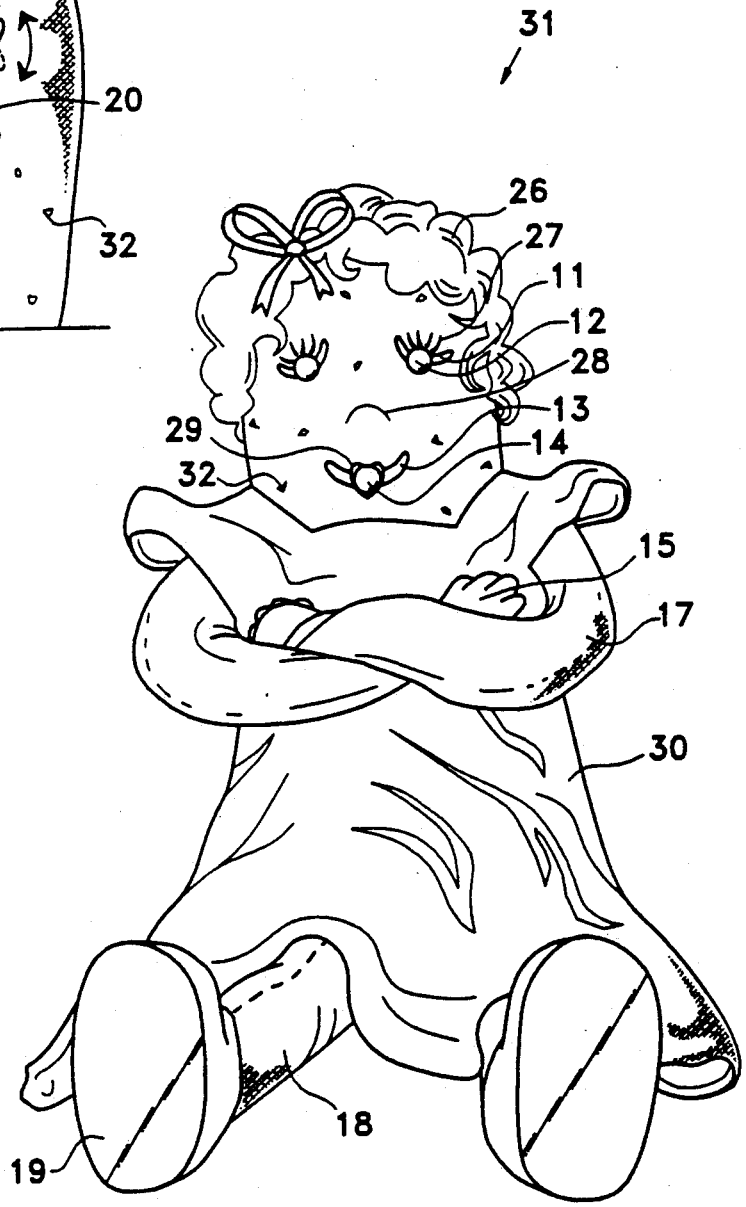
FIG. 7 is a front view of a female version of the stuffed toy seated with arms folded in front and with the happy face.

The nose 20 of the toy 10 may be in the shape of a four-leafed clover, glued to the face, or painted or embroidered thereon; or the nose 28 may be painted or embroidered in the shape of an arc as in FIG. 7.

Figure 4:
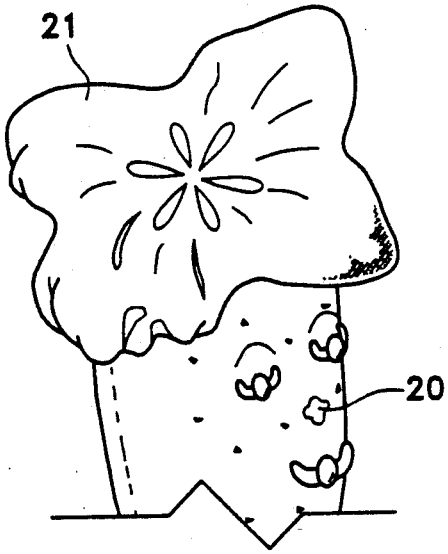
FIG. 4 is a perspective view from the top of the stuffed toy showing the detail on the top of the hat and the happy face.

It is not necessary for the toy to have clothes. The basic toy may have a hat 21 affixed to the top of the head. The hat 21 is in the shape of a pickle slice with embroidered seed detail on the top as seen in FIG. 4. The toy may also be clothed. The female toy 31 in FIG. 7 is wearing a dress 30. Any manner of attire may be chosen as would be appropriate to the nature of the character assigned to the toy.

While two embodiments of the present invention have been illustrated and described in detail, it is to be understood that this invention is not limited thereto and may be otherwise practiced within the scope of the following claims.

We claim:

1. A stuffed toy comprising:

(a) a contiguous head-body unit generally in the configuration of a pickle;

(b) two arcuately curved arm members segmented from the head-body unit affixed at one end to each side of said head-body unit, and each having a preformed hand attached at the opposing end, and said arm members capable of assuming multiple positions including being reversibly folded in front of said head-body unit;

(c) two leg members segmented from the head-body unit and each affixed to the bottom of the said head-body unit at one end and having an L-shape to form a foot portion at the opposing end;

(d) a face having eye and mouth features capable of rotation so as to exhibit alternately a happy face and a sad face; and (e) said eye and mouth features each comprising a synclinal member composed of a stiff but flexible material and said synclinal member being held in place by a rounded head bolt having a notched shaft, wherein said shaft passes through the synclinal member, then through the fabric of the face and lastly through a flanged washer which locks in place behind the face such that the bolt cannot be dislodged but the synclinal member can be manually rotated.

2. A stuffed toy as in claim 1 which is made of a strong cotton fabric.

3. A stuffed toy as in claim 1 wherein the head-body unit is textured to simulate the nubby surface of a pickle.

4. A stuffed toy as in claim 1 made of green material.

5. A stuffed toy as in claim 1 wherein the synclinal members are made of vinyl.

6. A stuffed toy comprising:

(a) a contiguous head-body unit generally in the configuration of a pickle;

(b) two arcuately curved arm members segmented from the head-body unit affixed at one end to each side of said head-body unit, and each having a preformed hand attached at the opposing end, and said arm members capable of assuming multiple positions including being reversibly folded in front of said head-body unit;

(c) two leg members segmented from the head-body unit and each affixed to the bottom of the said head-body unit at one end and having an L-shape to form a foot portion at the opposing end;

(d) a face having eye and mouth features capable of rotation so as to exhibit alternately a happy face and a sad face;

(e) said eye and mouth features each comprising a synclinal member composed of a stiff but flexible material and said synclinal member being held in place by a rounded head bolt having a notched shaft, wherein said shaft passes through the synclinal member, then through the fabric of the face and lastly through a flanged washer which locks in place behind the face such that the bolt cannot be dislodged but the synclinal member can be manually rotated; and (f) a rotatable heart-shaped member added to the mouth feature between the bolt head and the synclinal member such as to give the mouth feature a feminine appearance.

7. A stuffed toy as in claim 6 wherein the heart-shaped member is made of vinyl.

8. A stuffed toy comprising:

(a) a contiguous head-body unit generally in the configuration of a pickle;

(b) two arcuately curved arm members segmented from the head-body unit affixed at one end to each side of said head-body unit, and each having a preformed hand attached at the opposing end, and said arm members capable of assuming multiple positions including being reversibly folded in front of said head-body unit;

(c) two leg members segmented from the head-body unit and each affixed to the bottom of the said head-body unit at one end and having an L-shape to form a foot portion at the opposing end;

(d) a face having eye and mouth features capable of rotation so as to exhibit alternately a happy face and a sad face;

(e) said eye and mouth features each comprising a synclinal member composed of a stiff but flexible material and said synclinal member being held in place by a rounded head bolt having a notched shaft, wherein said shaft passes through the synclinal member, then through the fabric of the face and lastly through a flanged washer which locks in place behind the face such that the bolt cannot be dislodged but the synclinal member can be manually rotated; and (f) a stuffed hat, in the general shape of a pickle slice with seed detail on the top thereof, permanently affixed to the top of the head.

* * * * *